US007266947B2

(12) United States Patent
Keiter et al.

(10) Patent No.: US 7,266,947 B2
(45) Date of Patent: Sep. 11, 2007

(54) TEMPERATURE CONTROL FOR FREE-PISTON CRYOCOOLER WITH GAS BEARINGS

(75) Inventors: Douglas E. Keiter, Athens, OH (US); Ezekiel S. Holliday, Belpre, OH (US)

(73) Assignee: Sunpower, Inc., Athens, OH (US)

( * ) Notice: Subject to any disclaimer, the term of this patent is extended or adjusted under 35 U.S.C. 154(b) by 405 days.

(21) Appl. No.: 10/825,024

(22) Filed: Apr. 15, 2004

(65) Prior Publication Data

US 2005/0229608 A1 Oct. 20, 2005

(51) Int. Cl.
*F25B 9/00* (2006.01)

(52) U.S. Cl. ..... 62/6; 62/228.1

(58) Field of Classification Search ..... 62/6, 62/228.1

See application file for complete search history.

(56) References Cited

U.S. PATENT DOCUMENTS 4,543,793 A * 10/1985 Chellis et al. ..... 62/6
4,553,398 A * 11/1985 Young ..... 62/6
5,018,357 A * 5/1991 Livingstone et al. ..... 62/6
5,079,924 A * 1/1992 van der Broeck et al. ..... 62/6
5,156,005 A * 10/1992 Redlich ..... 62/6
5,385,021 A * 1/1995 Beale ..... 62/6
5,535,593 A 7/1996 Wu et al.
5,606,870 A * 3/1997 Lester ..... 62/434
5,752,385 A * 5/1998 Nelson ..... 62/6
6,098,409 A * 8/2000 Chase ..... 62/6
6,161,389 A * 12/2000 Sekiya et al. ..... 62/6
6,354,087 B1 * 3/2002 Nakahara et al. ..... 62/6
6,397,605 B1 * 6/2002 Pundak ..... 62/6
7,121,099 B2 * 10/2006 Shimizu et al. ..... 62/6

OTHER PUBLICATIONS

Fink, Donald G., Editor-in-Chief, "Electronics In Processing Industries", Electronics Engineers' Handbook, 1975, Sec. 24-10, p. 24-12-24-15, First Edition, McGraw Hill Book Company, Inc., USA.

D'Azzo, John J. and Houpis, Constantine H., "Feedback Control System Analysis and Synthesis", 1960, p. 2-3 and p. 505-507, McGraw-Hill Book Company, Inc., New York, USA.

* cited by examiner

*Primary Examiner*—Frantz Jules
*Assistant Examiner*—John Pettitt
(74) *Attorney, Agent, or Firm*—Frank H. Foster; Kremblas, Foster, Phillips & Pollick

(57) ABSTRACT

A cryocooler having two operating modes so that its operating range is broadened, its gas bearing system is maintained in an operable state and it can utilize piston stroke modulation for energy efficiency. A piston stroke modulator modulates the piston stroke when the commanded piston stroke exceeds the minimum stroke and maintains the minimum stroke when the commanded stroke is less than the minimum stroke. A heater applies heater power to the thermal load when the commanded piston stroke is less than the minimum piston stroke. A closed loop feedback control system is used which has two branches of its dynamic leg. One branch controls the modulation of the cryocooler and the second, parallel branch controls the modulation of the heater.

6 Claims, 3 Drawing Sheets

Fig. 1
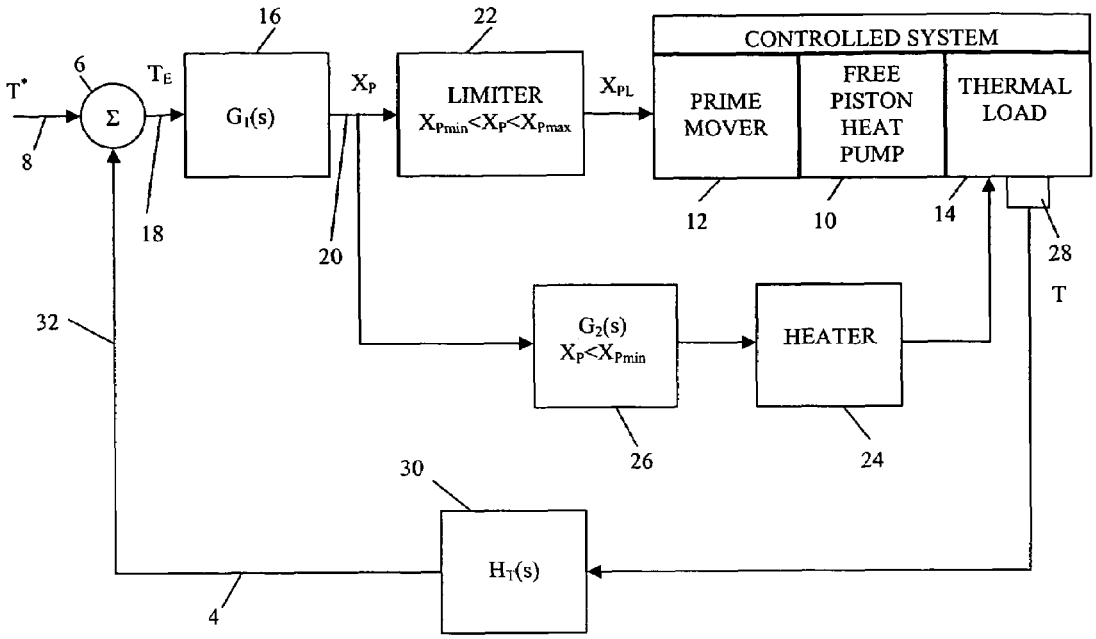
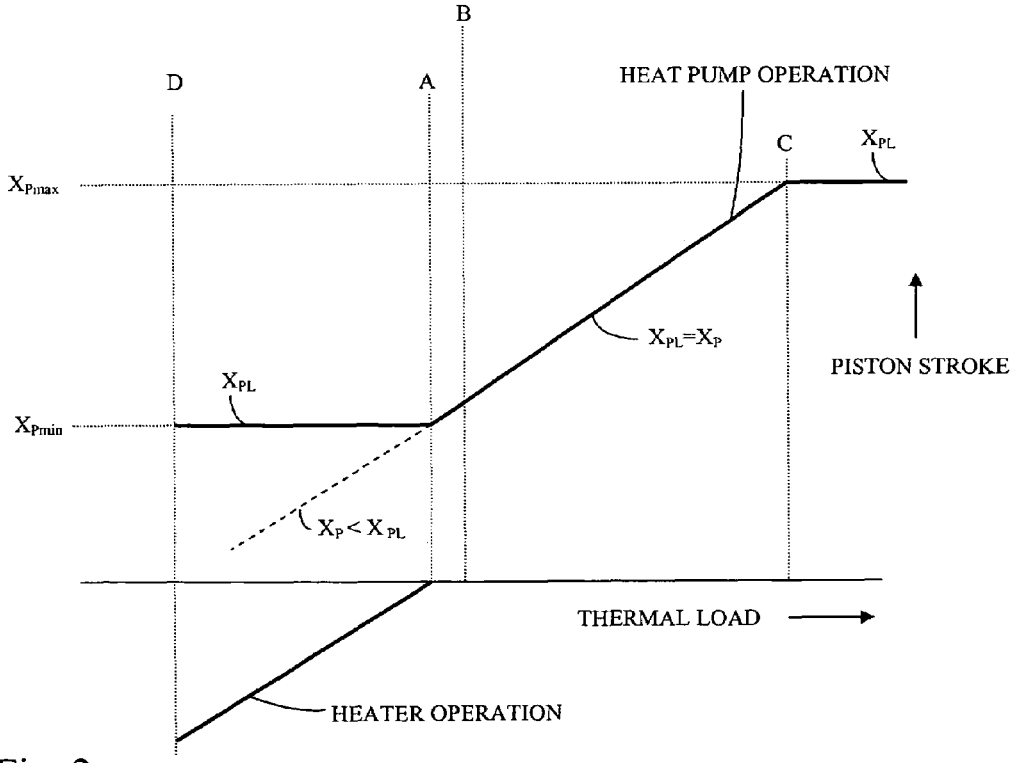
Fig. 2

TEMPERATURE CONTROL FOR FREE-PISTON CRYOCOOLER WITH GAS BEARINGS

BACKGROUND OF THE INVENTION

1. Field of the Invention

This invention relates generally to cryogenic refrigeration systems which have a free-piston, heat pump for lifting heat and are lubricated by gas bearings and more particularly relates to an improved closed loop control system which controls temperature and maintains effective gas bearing operation over a widened range of thermal load applications while permitting energy efficient, piston stroke modulation for controlling cooling power.

2. Description of the Related Art

The applications and uses for refrigeration systems which are capable of cooling to cryogenic temperatures have been expanding for several years. Consequently, designers have sought to improve performance and energy efficiency and reduce the cost of such systems. One important type of cryogenic refrigeration system uses a compressor which has a free piston. These include Stirling and pulse tube free piston cryocoolers. The free piston reciprocates in a cylinder without the restraint of a conventional crank and connecting rod linkage. The piston is driven in reciprocation by one of several types of prime movers, such as a linear electric motor.

One advantage of these free piston cryocoolers is that the stroke of the free piston can be controllably modulated, typically by a closed loop, negative feedback control system, to modulate the cooling power applied by the cryocooler to the work of lifting heat from the low temperature of the thermal load being cooled at the cold end to the ambient temperature at the warm end. The cooling power delivered by a free piston cryocooler is an increasing function of the stroke of the free piston. Therefore, the control system for the cryocooler can control the temperature of the thermal load by controlling the piston stroke to increase or decrease the cooling power over a range of cooling power demand, the term cooling power demand also being known as the thermal load. Piston stroke is controlled by controlling the stroke of and the power input to the prime mover driving the free piston. Energy efficiency can be maximized because the power input to the prime mover can increase and decrease as cooling power demand changes so that the delivered cooling power will equal the cooling power demand, i.e. the cooling power required to maintain the command input temperature.

One such cryocooler is shown in U.S. Pat. No. 5,535,593 to Wu et al. A Stirling cycle cryocooler has its cold finger tip temperature controlled by a closed loop control system which adjusts the stroke of its compressor piston as a function of cryocooler temperature.

The purity of the working gases used in free piston cryocoolers is critical to the operating performance of the cryocoolers. Therefore, ordinary petroleum lubricants are not used for lubrication because they contaminate the working gas. Instead, gas bearing systems are used which circulate a portion of the working gas through the space between the interfacing, relatively sliding components, such as between the piston outer surface and the cylinder surface, between a displacer and the cylinder or between a displacer rod and the piston. The gas operates as a fluid lubricant by applying a force on the interfacing surfaces which moves the surfaces away from contact.

Unfortunately, a gas bearing system requires a minimum gas flow rate which is sufficient to maintain its effectiveness.

The gas flow rate through the gas bearing system is an increasing function of piston stroke. Therefore, a minimum piston stroke constraint is imposed on such cryocoolers. Consequently, prior art cryocooler control systems must be designed to confine their range of operation to cooling power outputs between this minimum piston stroke required for gas bearing effectiveness and a maximum piston stroke which avoids damage to the cryocooler. If such a cryocooler encounters operating conditions in which the cooling power demand of the thermal load is less than the cooling power delivered at the minimum piston stroke, the cold finger temperature will not be maintained at the desired set point temperature, but instead will drift to colder temperatures.

One of the most important operating conditions is the temperature of the ambient environment in which the cryocooler is operating. Ambient temperature affects both the rate of heat transfer into the thermal load, such as by conduction through its surrounding insulation, and the rate of heat transfer rejected from the cryocooler into the ambient environment. Although the above limitations on piston stroke are not a problem if the operating conditions are confined to a narrower range, they become a problem if a broader range of operating conditions, such as ambient temperatures, can be anticipated, which includes conditions requiring less cooling power than the cooling power delivered by the heat pump at the minimum piston stroke. Additionally, designing a cryocooler which can operate only over a narrower range of operating conditions, limits the number of applications for which the cryocooler can be used.

It is therefore an object and feature of the invention to provide a cryocooler, including its prime mover and control system, which is capable of operating at a cooling power which is less than the cooling power delivered at its minimum piston stroke while still maintaining both its piston stroke at the minimum stroke necessary for proper gas bearing lubrication and the temperature of the thermal load at the set point temperature.

Another object and feature of the invention is to provide a cryocooler system which can take advantage of the energy efficiency of piston stroke modulation and is also capable of operating over a broader range of cooling power demands and therefore over a broader range of operating conditions, for example over a broad range of ambient temperature such as from −40° C. to +70° C., and for the same reason may be applied to a more extensive variety of applications and uses.

BRIEF SUMMARY OF THE INVENTION

The invention is a free piston cryocooler with a closed loop control system which has two modes of operation and control. For cooling power demands requiring a piston stroke in excess of the minimum piston stroke which is necessary for maintaining adequate operation of the gas bearing system, the cooling power is controlled by modulating the piston stroke as an increasing function of the difference between the sensed temperature of the mass being cooled and a command input or set point temperature. However, for output cooling power demands which require a piston stroke less than that minimum piston stroke, the piston stroke is maintained at the minimum stroke and thermal energy is applied to the mass being cooled by a heater, preferably as an increasing function of the difference between the cooling power applied to the mass by the cryocooler at the minimum piston stroke and the actual cooling power demand.

The cryocooler of the invention therefore has a piston stroke modulator connected to the prime mover which drives the piston and modulates the piston stroke when the desired piston stroke exceeds the minimum stroke and maintains the minimum stroke when the desired stroke is less than the minimum stroke. The cryocooler also has a heater and a heater modulator which controls the heater power when the desired piston stroke is less than the minimum piston stroke. For this purpose, a closed loop feedback control system is used which has two branches of its dynamic leg. One branch controls the modulation of the cryocooler and the second, parallel branch controls the modulation of the heater.

BRIEF DESCRIPTION OF THE SEVERAL VIEWS OF THE DRAWINGS

FIG. 1 is a simplified block diagram illustrating the invention.

FIG. 2 is a graph showing the relationship between piston stroke and cooling power and illustrating the operation of preferred embodiments of the invention.

Figure 3:
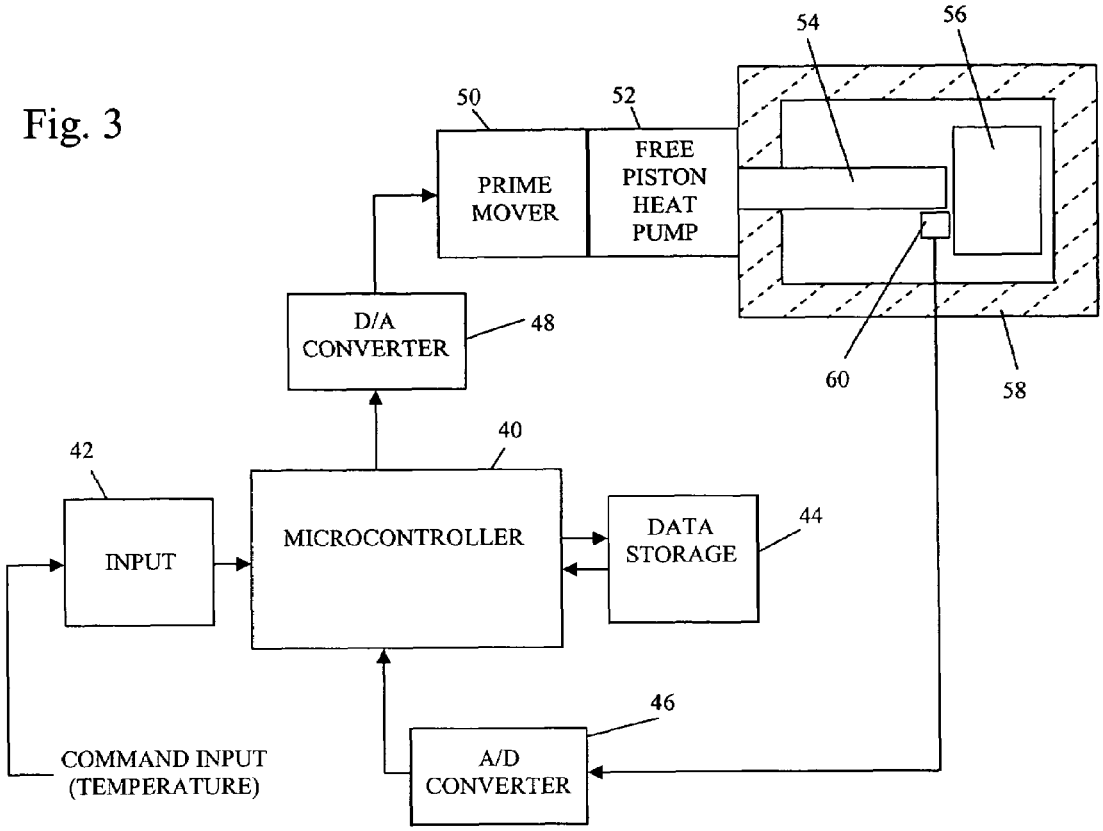
FIG. 3 is a block diagram of a computer microcontroller implementation of the invention.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the word connected or term similar thereto may be used. They are not limited to direct connection, but include connection through other elements where such connection is recognized as being equivalent by those skilled in the art.

DETAILED DESCRIPTION OF THE INVENTION

FIG. 1 illustrates the fundamental components of the apparatus of the invention and FIG. 2 is a graph which illustrates the operation of embodiments of the invention. FIG. 1 shows a closed loop, negative feedback system which has a dynamic leg, a feedback leg 4 for feeding back a temperature signal representing the actual cold end temperature, a summing junction 6 for generating an actuating signal representing the difference between the sensed actual temperature T of the cold end and a desired temperature T* represented by a command input 8. These components as described above are the basic components of a conventional closed loop control system.

The dynamic leg or control unit of the invention has two branches. The first branch of the dynamic leg includes the controlled system, which typically comprises a free piston heat pump 10, a prime mover 12 which drives the piston of the heat pump and a thermal load 14 which is cooled by the heat pump 10. This first branch also has a first control element which includes a component 16, providing a transfer function to convert the actuating signal at its input 18 to a piston drive signal $X_P$ at its output 20. The variable $X_P$ represents a commanded piston stroke.

The first branch of the dynamic leg also includes a second component, which is a limiter 22. The operation of the limiter 22 is illustrated in FIG. 2. In FIG. 2, $X_{Pmin}$ is the piston drive signal which drives the piston at the minimum stroke for proper gas bearing operation and provides cooling power A. $X_{Pmax}$ is the piston drive signal which drives the piston at the maximum stroke that avoids damage to the heat pump and provides cooling power C in FIG. 2. The limiter 22 applies the piston drive signal $X_P$ to the prime mover 12 whenever the amplitude or value of the drive signal is greater than the piston drive signal $X_{Pmin}$ and less than the drive signal $X_{Pmax}$. If the piston drive signal $X_P$ is less than that minimum stroke drive signal $X_{Pmin}$ (cooling power less than A in FIG. 2), the limiter applies $X_{Pmin}$ to the prime mover. If the piston drive signal is greater than $X_{Pmax}$ (cooling power greater than C in FIG. 2), the limiter applies $X_{Pmax}$ to the prime mover. In summary, the limiter applies a conventional hysteresis function to the piston drive signal $X_p$ to provide a limited piston drive signal $X_{PL}$ to the prime mover which limits $X_{PL}$ to values of $X_{Pmin}<X_{PL}<X_{Pmax}$ as illustrated in FIG. 2 for the graph identified as "heat pump operation".

This above-described first branch of the dynamic leg therefore provides a piston stroke modulator which converts the actuating signal $T_E$ at its input 18 to a piston drive signal $X_{PL}$ which equals $X_P$ for controlling the piston stroke when the desired piston stroke exceeds the minimum piston stroke for maintaining sufficient gas bearing operation but maintains the piston stroke at its minimum stroke when the piston drive signal is less than the drive signal for the minimum stroke.

The second branch of the dynamic leg has a second controlled element which includes a heater 24. The heater 24 is in thermal connection to the thermal load 14 so that the heater 24 can apply heat to the thermal load 14 in order to maintain the temperature of the thermal load 14 whenever the control system seeks to reduce the total cooling power below the cooling power delivered by the heat pump at the minimum piston stroke. This occurs when the piston drive signal $X_P$ is less than the value of $X_{Pmin}$ because the system is trying to reduce cooling power but the piston is driven at the minimum stroke by $X_{Pmin}$. The second branch of the dynamic leg also has a control element 26 to which an actuating signal is applied. Preferably the actuating signal is applied from the piston drive signal $X_P$ but, as is apparent to those skilled in the art, it could alternatively be applied from the actuating signal $T_E$ with the transfer function of the control element 26 then modified to also provide a function like that of control component 16. The heater control element 26 causes the heater 24 to apply no heating power to the thermal load 14 whenever the piston stroke exceeds the minimum stroke $X_{Pmin}$ (cooling power greater than A in FIG. 2) and causes the heater 24 to apply heat to the thermal load 14 when the piston drive signal $X_P$ is less than the minimum stroke value $X_{Pmin}$ (cooling power less than A in FIG. 2). The heater control element 26 applies an increasing heating power as a function of the decreasing actuating signal below the signal for minimum piston stroke. In other words, the more the control system seeks to reduce the piston stroke below $X_{Pmin}$ the more heating power that it applies, as illustrated in FIG. 2 for the graph identified as "heater operation".

The above described second branch of the dynamic leg therefore is a heating apparatus, including a heater 24 in thermal connection to the cold end or cold finger of the cryocooler and its thermal load 14, and modulates the heating power as an increasing function of the difference between the minimum piston stroke and the desired piston stroke at which the control system seeks to drive the piston when the piston stroke is held at $X_{Pmin}$ by the limiter 22. In other words, the heating power is an increasing function of $X_{Pmin}$-$X_P$ for positive values of the difference and zero for negative values.

The feedback loop 4 may be conventional and includes a temperature sensor 28 for sensing the temperature of the thermal load 14 and a feedback element 30 connected to it to apply a temperature feedback signal at the input 32 of the summing junction 6.

As known to those skilled in the art, the control system illustrated and described can be implemented in either analog or digital forms. The mathematical and signal operations of the control algorithm can be implemented in a general or special purpose digital computer or microcontroller. In any of these digital computers, the "signals" are the digital data signals. It is preferred to use an analog temperature sensor on the cold end, a resistive heater on the cold end, and a microprocessor—digital signal processor to do all the control laws. As also known to those skilled in the art, there are a great variety of structures which can be used for each of the control block elements. There are many ways to implement such feedback control systems. Similarly, the particular transfer functions used in embodiments of the invention are not a part of the invention except that they should have the characteristics which are described.

A digital computer implementation of the invention is illustrated in FIG. 3. The digital hardware components are conventional, including the microcontroller 40, input peripheral 42, data storage 44, feedback loop input A/D converter 46 and output D/A converter 48. As illustrated in FIG. 1, the output from the D/A converter 48 is applied to the prime mover 50 which drives the heat pump 52 for cooling the cold finger 54 and the thermal load 56. The cold finger 54 and the thermal load 56 are encased in an insulative enclosure 58 and their temperature is detected by the temperature sensor 60 for the feedback loop.

The operation of the apparatus described above illustrates the method of the invention for controlling the temperature of a mass which is cooled by a free piston cryocooler. There are two modes of operation for controlling the temperature of the thermal load. In the first mode, for output cooling power demands requiring a piston stroke exceeding a selected minimum piston stroke, the output cooling power of the cryocooler is controlled by modulating the piston stroke as an increasing function of the difference between the sensed temperature of the mass being cooled and a command reference input temperature. In the second mode, for output cooling power demands requiring a piston stroke less than the selected minimum stroke, the piston stroke is maintained at the selected minimum stroke and thermal energy is applied to the thermal load.

The typically encountered selected minimum piston stroke is the minimum stroke which is required to maintain satisfactory operation of the gas bearing system of the cryocooler. Preferably, in the second operating mode the thermal energy is applied to the thermal load as an increasing function of the difference between the cooling power which is applied to the thermal load by the cryocooler when its piston reciprocates at the minimum stroke and the cooling power demand. The heating power applied to the thermal load compensates for the excess cooling power applied to the load by the cryocooler when the piston reciprocates at the minimum stroke rather than at the reduced stroke which would be appropriate for the cooling power demand but would make the gas bearing system operate with diminished or lost effectiveness. FIG. 2 illustrates this compensation in the cooling power range between A and D where the net thermal power applied to the thermal load is the sum of the cryocooler cooling power and the heater heating power.

FIG. 2 also illustrates how the invention extends the range of cryocooler operation, which not only allows a cryocooler used for a particular application to operate over a broader range of operating conditions but also permits a cryocooler design to be used for a broader diversity of applications. If control of temperature relies solely upon the modulation of the piston stroke, as in the prior art, then cryocooler operation is confined to the range of cooling power between A and C of FIG. 2. However, with the application of the principles of the invention, the range can be extended to cooling power between D and C. Consequently, the cryocooler can be designed for a nominal or average operating point at a cooling power B which is a little greater than A, but is closer to A than to C and may be in the middle of the broadened range of operation between D and C.

Figure 4:
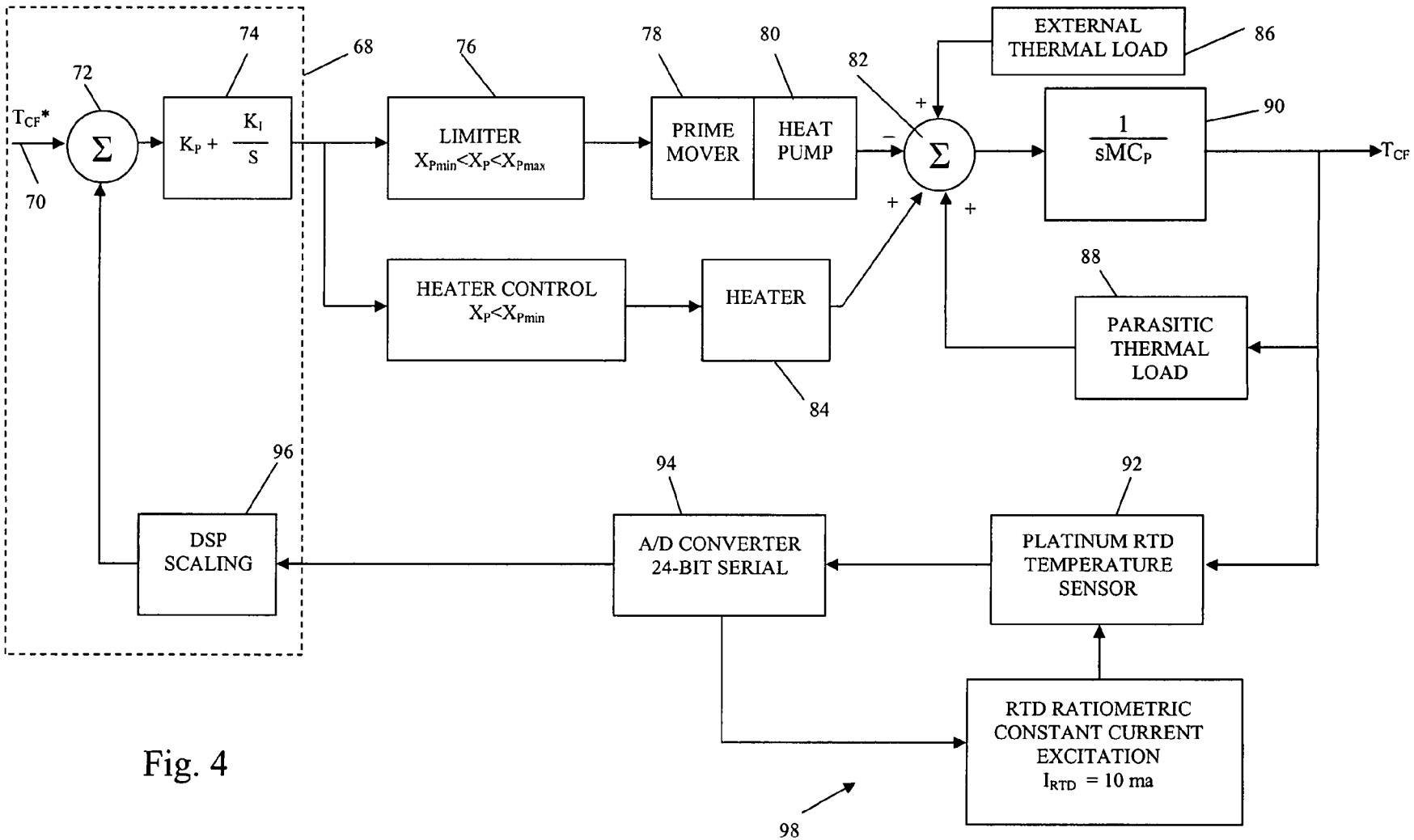
FIG. 4 is more detailed block diagram illustrating the preferred embodiment of the invention.

FIG. 4 illustrates the preferred and more detailed embodiment of the invention. It has the same basic configuration as shown in FIG. 1 and the component details are described to the extent they are not shown in FIG. 1. The components of a digital signal processor 68 are implemented in software and has a commanded cold finger temperature or set point $T_{CF}$*, for example 77°K, applied at input 70 to the summing junction 72. The actuating signal, representing the difference or error, is applied to a control element 74 having the transfer function illustrated in FIG. 4 for converting the temperature error to a commanded piston stroke $X_P$. The constants $K_P$ and $K_I$respectively represent the proportional gain constant and the integrator gain constant for a temperature loop PI controller and s is the conventional Laplace variable. The PI controller is sometimes referred to as a proportional plus reset control (P+I) and applies an actuating signal to the limiter 76 which operates as described above. For example, the limiter 76 may confine its output to an $X_{Pmin}$ of 4 mm and an $X_{Pmax}$ of 6.5 mm. The output of the limiter 76 is applied to a prime mover 78 for driving a heat pump 80 which, for example, may have a heat lift of 0.5 watts at $X_{Pmin}$ and a heat lift of 5.0 watts at $X_{Pmax}$.

Thermal power at the last stage of the controlled system is shown as a summing junction 82 to and from which heat is transferred. Heat is applied by the heater 84, an external load 86 representing the mass being cooled, a parasitic thermal load 88 representing heat absorbed from the ambient environment. Heat is transferred from the summing junction by the heat pump 80. The transfer function 90 represents thermal inertia and establishes a time constant for the cold finger. M represents the mass of everything at the end of the cold finger, including the cold finger itself, the item being cooled and any mounting structure. $C_P$ is the specific heat of the mass M and s is the usual Laplace transform variable. Its output represents the controlled variable $T_{CF}$ which is the cold finger temperature.

The feedback loop includes a conventional, thermocouple temperature sensor 92 which, for example, may exhibit a resistance characteristic of 19.2230 ohms at 77°K, 100.00 ohms at 0° C. and 116.27° C. at 32° C. The output of the temperature sensor 92 provides an analog signal representing $T_{CF}$ which is converted to digital format by the A/D converter 94, applied to the digital signal processor 68 and scaled by the block 96. Thermocouple noise is filtered in the conventional manner by the circuit 98.

While certain preferred embodiments of the present invention have been disclosed in detail, it is to be understood that various modifications may be adopted without departing from the spirit of the invention or scope of the following claims.

The invention claimed is:

1. A method for controlling the temperature of a mass cooled by a free piston cryocooler, the method comprising:

(a) for output cooling power demands requiring a piston stroke exceeding a selected minimum piston stroke, controlling the output cooling power of the cryocooler by modulating piston stroke as an increasing function of the difference between sensed mass temperature and a command reference input temperature, wherein the selected minimum piston stroke is the minimum piston stroke necessary to maintain gas bearing lubrication of the cryocooler; and (b) for output cooling power demands requiring a piston stroke less than the selected minimum piston stroke, maintaining the piston stroke at substantially the selected minimum piston stroke and applying thermal energy to the mass wherein the thermal energy is applied as an increasing function of the difference between the cooling power applied to the mass by the cryocooler at the selected minimum piston stroke and the cooling power demand wherein, for nominal design operation, the output cooling power demand is greater than the output cooling power at the selected minimum piston stroke and is nearer the output cooling power at the selected minimum piston stroke than the output cooling power demand is to the cooling power at a maximum permissible piston stroke.

2. A method for controlling the temperature of a mass cooled by a free piston cryocooler, the cryocooler having a piston and a closed loop control system, the control system deriving a piston drive signal from the difference between a set point signal and a fed back temperature signal representing the temperature of the mass, the method comprising:

(a) for piston drive signals corresponding to piston strokes exceeding a selected minimum piston stroke, controlling the output cooling power of the cryocooler by the piston drive signal;

(b) for piston drive signals corresponding to piston strokes less than the minimum piston stroke, maintaining the piston stroke at substantially the minimum piston stroke; and (c) for piston drive signals corresponding to piston strokes less than the minimum piston stroke, applying thermal energy to the mass as an increasing function of the difference between the piston drive signal for the minimum piston stroke and the piston drive signal.

3. A method in accordance with claim 2, wherein the selected minimum piston stroke is at the piston stroke necessary to maintain gas bearing lubrication of the cryocooler.

4. An improved, temperature controlled, free piston cryocooler including a free piston driven in reciprocation by a prime mover having a modulatable stroke, the cryocooler including a cold end and a warm end and being capable of transporting heat away from a thermal mass providing a thermal load and positioned at the cold end, the cryocooler having a feedback control system including (i) a temperature command input for inputting a reference signal representing a desired cold end temperature of the thermal mass (ii) a feedback loop including a temperature sensor at the cold end for generating a signal representing actual cold end temperature, and (iii) a summing junction for generating an actuating signal representing the difference between the desired temperature and the actual temperature of the cold end, the improvement comprising the combination of:

(a) a piston stroke modulator connected to receive the actuating signal and for converting the actuating signal to a piston drive signal representing a desired piston stroke, the modulator connected to the prime mover for controlling the prime mover stroke when the desired piston stroke exceeds a selected minimum stroke and maintaining the minimum stroke when the desired piston stroke is less than the minimum stroke; and (b) a heating apparatus including a heater in thermal connection to the cold end and a heater control element having an input connected to receive the piston drive signal for modulating the heater power as an increasing function of the difference between the desired piston stroke and the minimum piston stroke when the desired piston stroke is less than the minimum piston stroke.

5. An improved closed loop control system for controlling a free piston cryocooler having a heat pump including a piston, the control system controlling the temperature of a mass being cooled by the cryocooler and including (i) a dynamic leg, (ii) a reference input for inputting a desired, set point temperature and (iii) a feedback leg including a temperature sensor in thermally conductive connection to the mass being cooled, for comparison of a signal from the temperature sensor to the reference input to provide a first actuating signal, the improvement comprising:

(a) a first branch of the dynamic leg for controlling the piston amplitude of oscillation comprising:

(i) a first controlled element including the prime mover and the heat pump; and (ii) a first control element having an output connected to an input of the first controlled element and an input to which a first actuating signal is applied for controlling the piston amplitude of oscillation, the first control element including a limiter for maintaining the output of the first control element greater than a selected piston limit value substantially corresponding to a minimum piston stroke; and (b) a second, parallel branch of the dynamic leg comprising:

(i) a second controlled element including a heater in thermally conductive connection to the mass; and (ii) a second control element having an output connected to an input of the second controlled element and an input to which a second actuating signal is applied for controlling the heating power output of the heater, the second actuating signal being the same as or derived from the first actuating signal, the second control element, for a second actuating signal value exceeding the selected piston limit value, applying substantially no heating power and, for a second actuating signal value less than the selected piston limit value, applying increasing heating power as a function of decreasing second actuating signal value.

6. A control system in accordance with claim 5 wherein the control elements comprise a digital microprocessor and associated storage forming a programmed computer system having control instructions and algorithms stored in the storage.

* * * * *